US006637247B2

(12) United States Patent
Bowlin

(10) Patent No.: US 6,637,247 B2
(45) Date of Patent: Oct. 28, 2003

(54) AIR MANIFOLD

(75) Inventor: Geoffrey R. Bowlin, Oak Ridge, NC (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/985,926

(22) Filed: Nov. 6, 2001

(65) Prior Publication Data

US 2003/0084696 A1 May 8, 2003

(51) Int. Cl.[7] ..... B21B 19/00
(52) U.S. Cl. ..... 72/94; 72/347; 137/884
(58) Field of Search ..... 72/94, 347, 352; 137/1, 625.43, 884

(56) References Cited

U.S. PATENT DOCUMENTS 3,635,069 A * 1/1972 Eickenhorst ..... 72/345
3,741,227 A * 6/1973 Mokadam et al. ..... 137/71
3,797,429 A * 3/1974 Wolfe ..... 72/344
RE31,529 E * 3/1984 Lowe ..... 137/884
4,509,555 A * 4/1985 Stirbis ..... 137/625.11
4,519,232 A 5/1985 Traczyk et al.
4,996,865 A * 3/1991 Haulsee et al. ..... 72/349
5,282,375 A * 2/1994 Lee et al. ..... 72/4
5,678,445 A * 10/1997 Schultz ..... 72/352
5,832,769 A * 11/1998 Schultz ..... 72/352
5,960,666 A * 10/1999 Schultz ..... 72/352
6,167,743 B1 * 1/2001 Marritt et al. ..... 72/352

FOREIGN PATENT DOCUMENTS

WO WO 97/37786 * 10/1997 ..... B21D/22/00

* cited by examiner

*Primary Examiner*—Allen Ostrager
*Assistant Examiner*—John S Goetz
(74) *Attorney, Agent, or Firm*—Foley & Lardner

(57) ABSTRACT

The invention includes an air manifold comprising at least one port adapted for receiving high pressure air from a compressor, at least one port adapted for receiving low pressure air from a compressor, at least one port adapted for bleeding high pressure air from a container, at least one port adapted for reusing high pressure bleed air. The port for reusing high pressure air receiving high pressure air from the port adapted for bleeding high pressure air. The air manifold also includes at least one port adapted for bleeding low pressure air from a container and at least one port adapted for reusing low pressure bleed air. The port for reusing low pressure air receiving low pressure air from the port adapted for bleeding low pressure air. The present invention also includes an air distribution system and a necking machine which include the manifold as well as a method of necking a can.

23 Claims, 9 Drawing Sheets

AIR MANIFOLD

FIELD OF THE INVENTION

The present invention is generally related to two piece can making equipment, and more specifically related to an air manifold for can making equipment, and a necking machine incorporating the air manifold.

BACKGROUND OF THE INVENTION

Static die necking is a process whereby the open ends of can bodies are provided with a neck of reduced diameter utilizing a necking tool having reciprocating concentric necking die and pilot assemblies that are mounted within a rotating necking turret and movable longitudinally under the action of a cam follower bracket to which the necking die assembly is mounted. The cam follower bracket thereby rotates with the turret while engaging a cam rail mounted adjacent and longitudinally spaced from the rear face of the necking turret. A can body is maintained in concentric alignment with the open end thereof facing the necking tool of the concentric die and pilot assemblies for rotation therewith. The reciprocating pilot assembly is spring loaded forwardly from the reciprocating die member. The forward portions of the die member and pilot assembly are intended to enter the open end of the can body to form the neck of the can.

More specifically, the die member is driven forwardly and, through its spring loaded interconnection with the pilot assembly, drives the pilot assembly forwardly toward the open end of the can. The outer end of the pilot assembly enters the open end of the can in advance of the die member to provide an anvil surface against which the die can work. The forward advance of the pilot assembly is stopped by the engagement of a homing surface on the necking turret with an outwardly projecting rear portion of the pilot assembly, slightly before the forward portion of the die member engages the open end of the can. As the die member continues to be driven forwardly by the cam, its die forming surface deforms the open end of the can against the anvil surface of the pilot assembly to provide a necked-in end to the can body.

A necking machine of the type discussed above is disclosed, for example, in U.S. Pat. Nos. 4,457,158 and 4,693,108. In the U.S. Pat. 4,693,108, each necking station also has a container pressurizing means in the form of an annular chamber formed in the pilot assembly. The container pressurizing means acts as a holding chamber prior to transmitting the pressurized fluid into the container from a large central reservoir located in the necking turret. In the type of static die necking discussed above to which the present invention pertains, pressurized fluid internally of the container is critical to strengthen the column load force of the side wall of the container during the necking process. There are particular problems inherent in introducing sufficient pressurized fluid into the container as the speed of production is increased. Further, the cost of pressurized air has risen to be a significant percentage of the cost of manufacturing.

A necking machine addressing these problems is disclosed in PCT/US97/05635. This necking machine includes a manifold, illustrated schematically in FIG. 1, adapted to supply air at different pressures to the can. Specifically, the manifold includes ports which supply low, medium and high pressure air to the can. The manifold also includes low, medium and high pressure bleed ports which recycle air from the formed can back to succeeding cans to be formed. By recycling air, this design reduces the total amount of air necessary in the forming process. Although this necking machine represents an improvement over earlier necking machines, the use of three distinct pressure supplies and three recycle streams results in a much more complicated necking machine.

Therefore, it would be advantageous to have a relatively simple manifold, necking machine, and method of necking a can which supplies sufficient air to maintain the can under pressure while necking, yet requires less air than conventional devices and methods.

SUMMARY OF THE INVENTION

Briefly, in one embodiment, the present invention includes an air manifold adapted for use in a can necking module comprising at least one port adapted to supply low pressure air to a can prior to necking, at least one port adapted to supply high pressure air to a can prior to necking, at least one port adapted for bleeding high pressure air from a can after necking, at least one port adapted for bleeding low pressure air from a can after necking and not having ports adapted to supply or bleed air at pressures intermediate between the high and low pressures.

The present invention also includes a necking module comprising an air manifold having at least one port adapted to supply low pressure air to a can prior to necking, at least one port adapted to supply high pressure air to a can prior to necking, at least one port adapted for bleeding high pressure air from a can after necking, at least one port adapted for bleeding low pressure air from a can after necking and not having ports adapted to supply or bleed air at pressures intermediate between the high and low pressures, a necking die and a rotor.

In addition, the present invention includes an air distribution system for can necking comprising an air compressor, a high pressure line, a low pressure line; and a least one necking module having an air manifold including at least one port adapted to supply low pressure air to a can prior to necking, at least one port adapted to supply high pressure air to a can prior to necking, at least one port adapted for bleeding high pressure air from a can after necking, at least one port adapted for bleeding low pressure air from a can after necking and not having ports adapted to supply or bleed air at pressures intermediate between the high and low pressures.

The present invention also includes a method of necking a can comprising the steps of supplying a first can to a necking module including an air manifold having ports adapted for low pressure air, ports adapted for high pressure air and not having ports at pressures intermediate between the high and low pressures, charging a first can with low pressure bleed air through a first reuse port, charging the first can with high pressure bleed air through a second reuse port, charging the first can with high pressure air from a compressor through at least one feed port, inserting the first can into a necking die, necking the first can, bleeding high pressure air from the first can to at least one succeeding can through a first regen port and bleeding low pressure air from the first can to at least one succeeding can through a second regen port.

It is to be understood that both the foregoing general description and the following detailed description are exemplary and explanatory only, and are not restrictive of the invention as claimed.

BRIEF DESCRIPTION OF THE DRAWINGS

The foregoing and other features, aspects and advantages of the present invention will become apparent from the following description, appended claims and the exemplary embodiments shown in the drawings, which are briefly described below.

DETAILED DESCRIPTION OF THE PREFERRED EMBODIMENTS

The present inventor discovered that it is possible to fabricate a relatively simple necking machine for can manufacture which supplies sufficient air to maintain the can under pressure while necking and which requires less air than conventional devices and methods. This discovery is accomplished with a novel air manifold which provides for the use of high and low pressure recycled air. In addition, this discovery has resulted in a novel manifold, a novel necking machine, a novel air distribution system for the necking machine and a novel method of necking.

Figure 1:
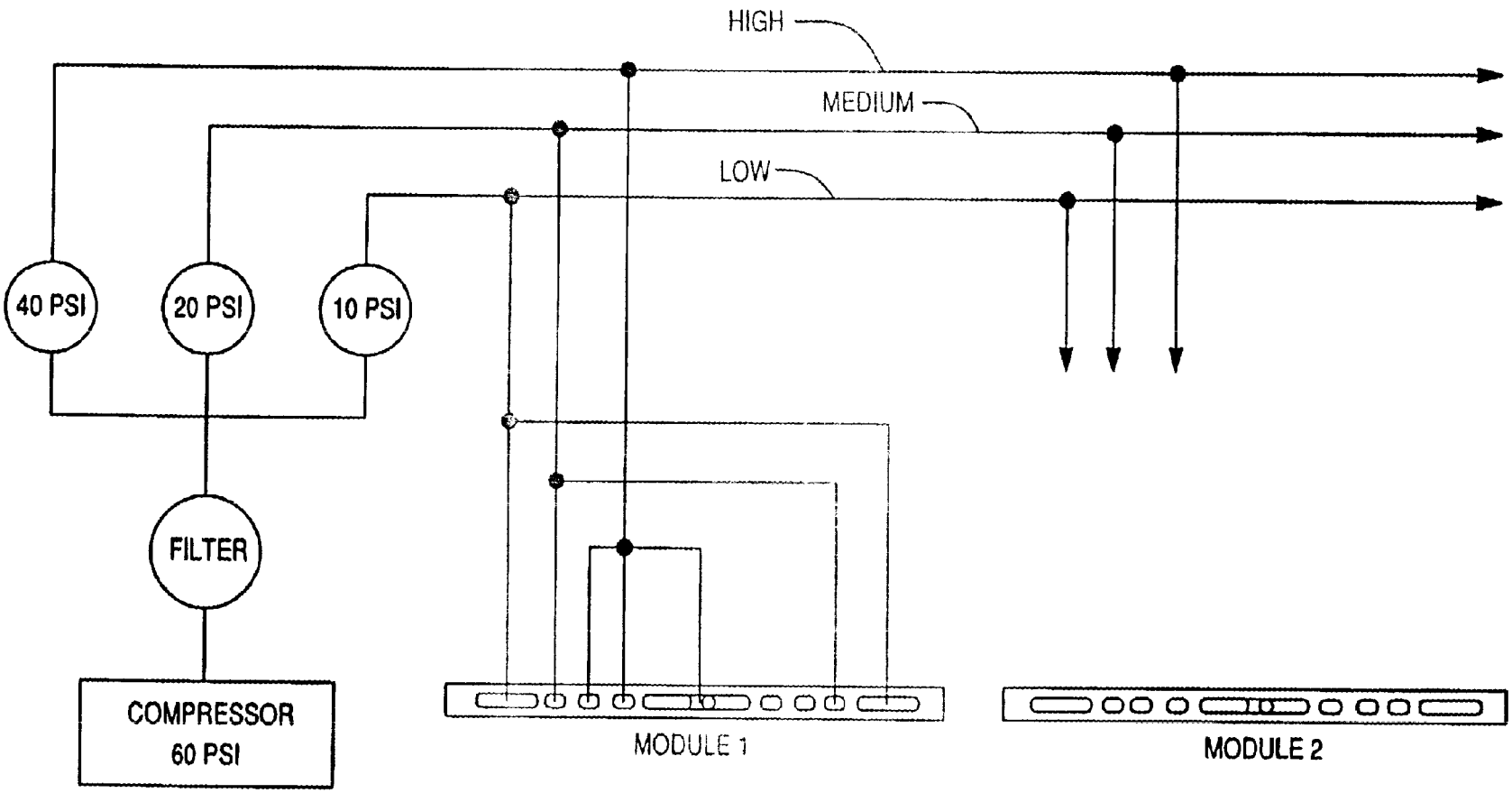
Fig. 1 Prior Art
FIG. 1 is a schematic diagram of a prior art air manifold and a prior art air distribution system using the manifold.
Figure 2:
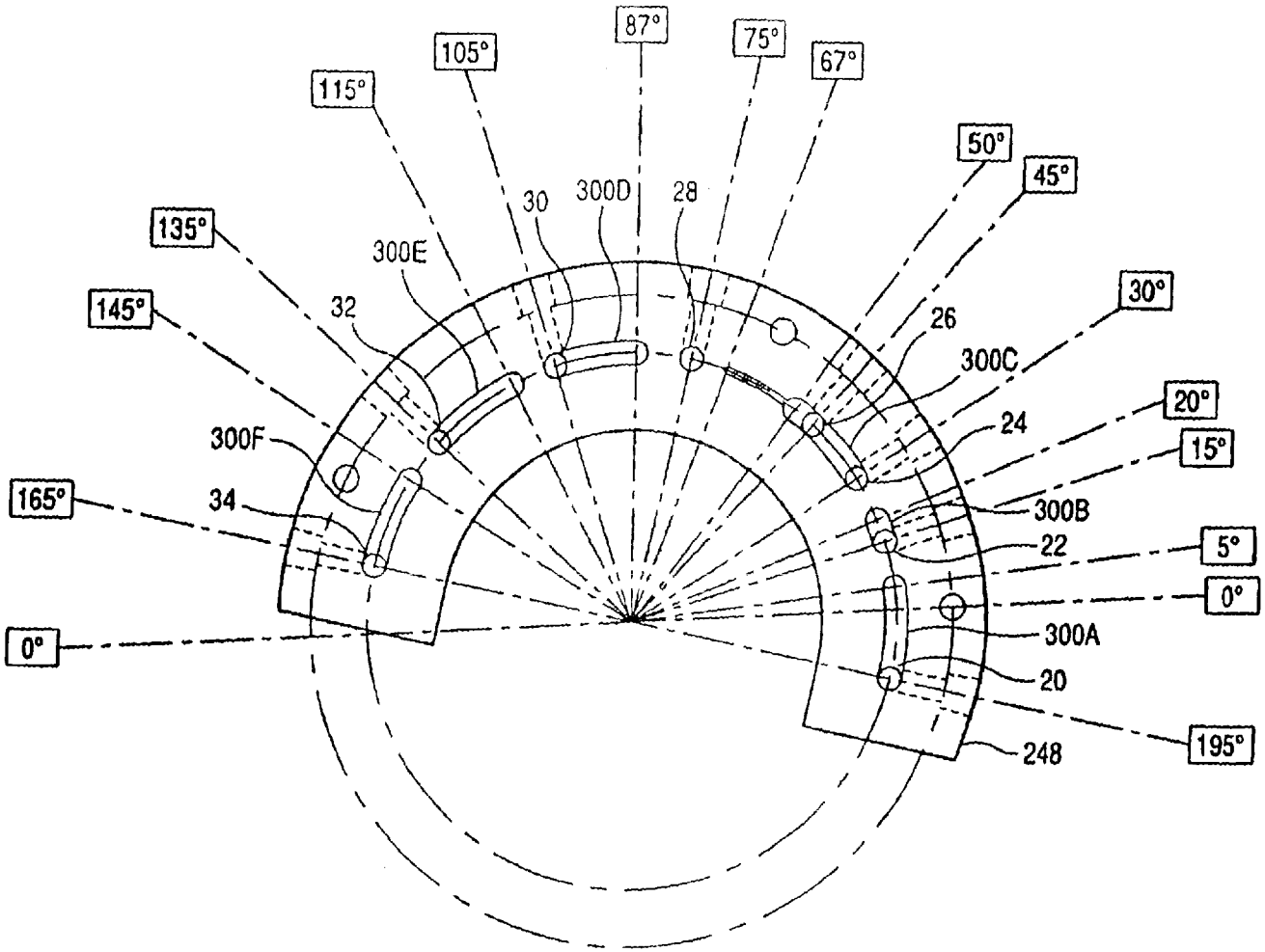
FIG. 2 is a plan view of an air manifold according to the present invention.

FIG. 2 illustrates an air manifold 248 according a preferred embodiment of the invention. The air manifold 248 is generally arcuate or horseshoe shaped, spanning an angle of approximately 180 degrees. The air manifold 248 includes eight ports 20–34: a first reuse port 20; a second reuse port 22; a first high pressure feed port 24; a second high pressure feed port 26; a monitoring port 28; a first regen port 30; a second regen port 32 and a low pressure feed port 34. Additionally, several of the ports comprise arcuate timing slots 300A–300F. The use and design of the various ports and slots and advantages of the preferred embodiment of the invention are described in more detail below.

Figure 3:
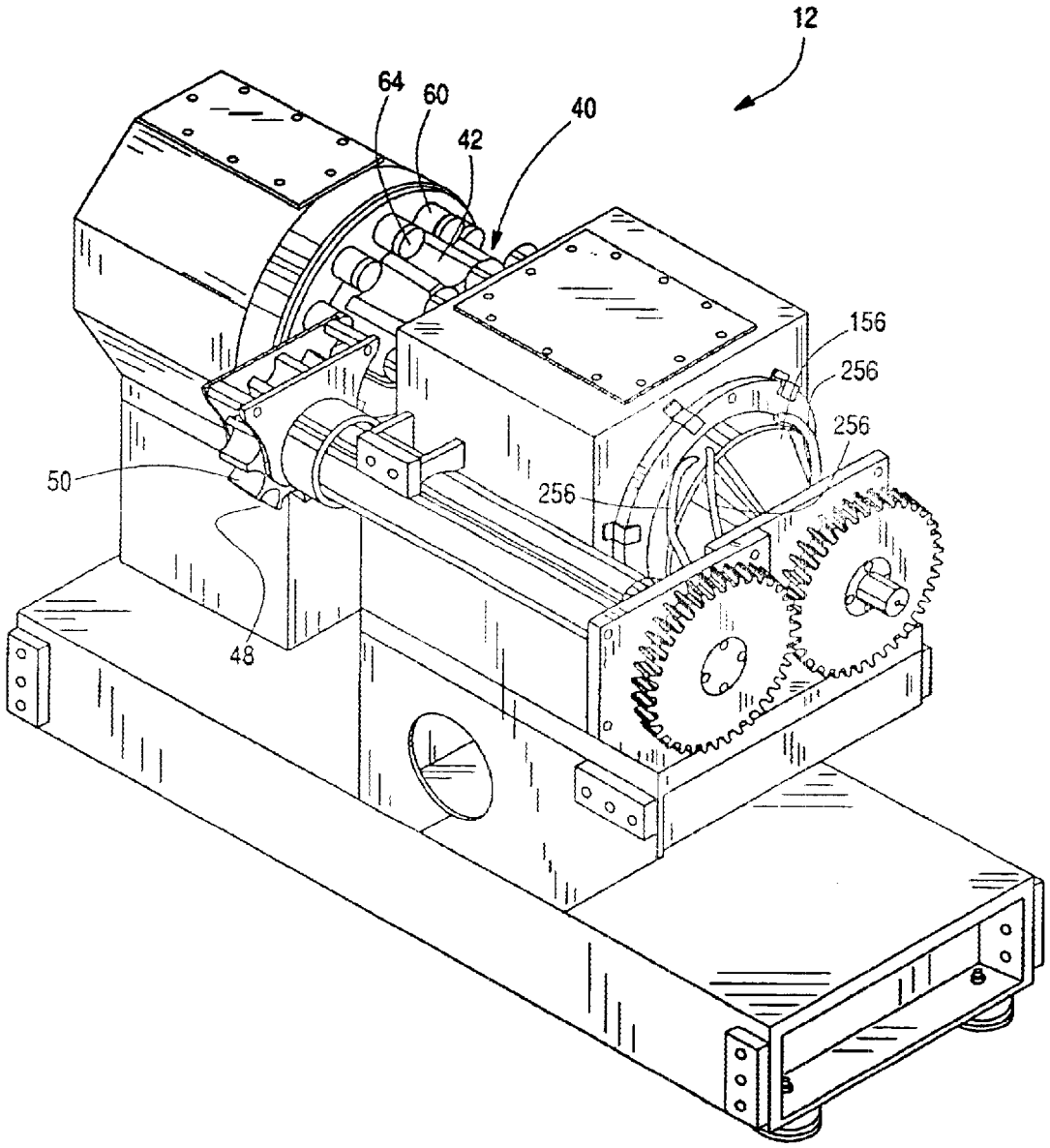
FIG. 3 is a perspective view of a necking module according to the present invention.
Figure 4:
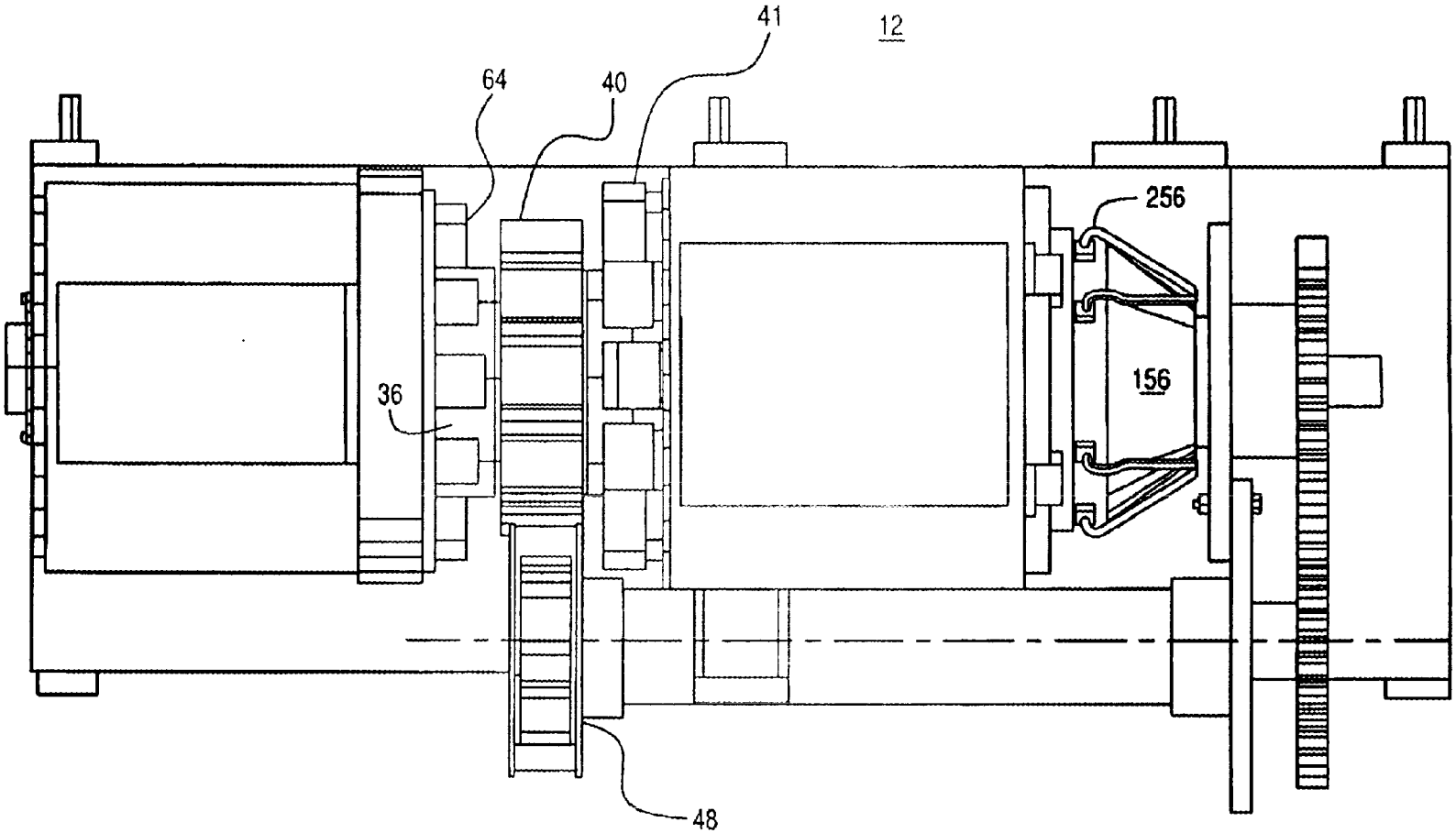
FIG. 4 is plan view of the necking module of FIG. 2.

The preferred necking module 12 of the present invention is illustrated in FIGS. 3 and 4. The air manifold 248 of the present invention is designed so that it reduces the amount of air needed during necking. The reduction in air in the present invention is achieved with the conservation and recycling of internally applied air pressure to the cans during forming in the necking module 12. The necking module 12 comprises a transfer star wheel 48 having twelve vacuum assisted transfer pockets 50 and a main star wheel 40 having twelve pockets 42. When a can is transferred to the main star wheel 40, it is contacted by a pusher pad 64 and driven forward into a necking die 41 by a push ram 60. The necking die 41 is mounted on a turret assembly (not shown), which rotates in concert with the main star wheel 40. Also rotating in concert is an air distribution rotor 156 which distributes air from the air manifold 248 to the can.

Figure 5:
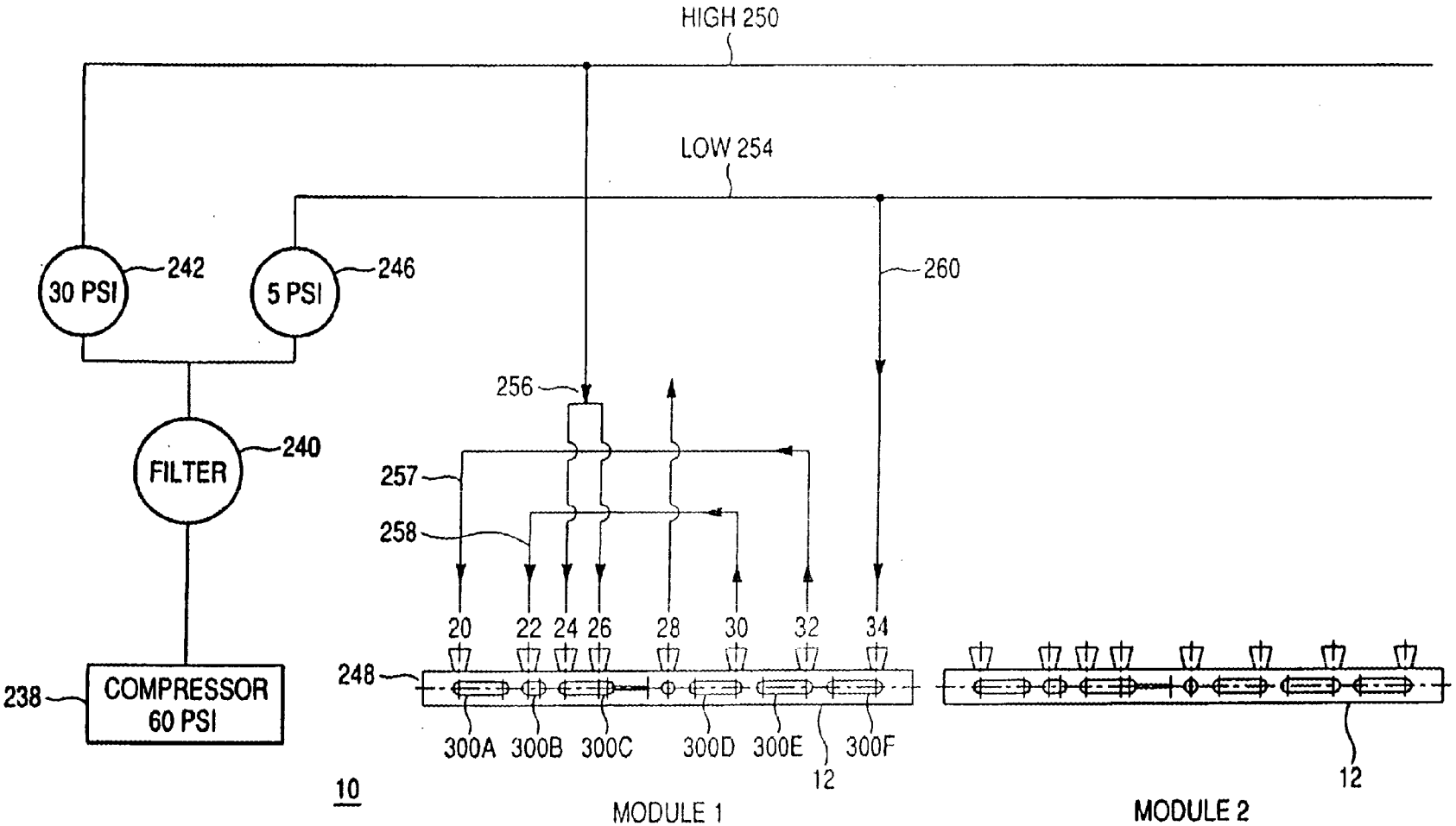
FIG. 5 is a schematic diagram of an air distribution system according to the present invention.

The operation of the air manifold 248 and the necking module 12 is best understood in conjunction with the preferred air distribution system 10. A schematic diagram of the preferred air distribution system 10 of the present invention is illustrated in FIG. 5. The preferred air distribution system 10 comprises an air compressor 238 which provides a main air supply pressure of nominally 60 psig. The incoming supply is filtered in a filter 240 before being split to different pressure regulators: a high pressure regulator 242 and a low pressure regulator 246. The air pressures are then fed to a horseshoe shaped air manifold 248 in an air manifold assembly (not shown) via high and low pressure headers 250, 254. Preferably, the high pressure is between 20 and 50 psig and the low pressure is between 1 and 10 psig. Typically, the high pressure header 250 is maintained at 30 psig and the low pressure header 254 is maintained at 5 psig. Each supply is regulated and a dial gives the actual pressures.

Air is transferred from the incoming supply headers 250,254 to each necking module 12 through pipes. Header 250 carries the high pressure air and divides into two polyflow (reinforced polyethylene) hoses 256 connected to the air manifold 248. Low pressure header 254 carries the low pressure air and is connected to the air manifold 248 through polyflow hose 260. This air distribution arrangement is repeated identically for each necking module 12 in the air distribution system 10.

Typically, with the air manifold 248 and the air distribution system 10 of the present invention, each of the necking modules 12 requires a volume of 50 SCFM air flow from the high pressure compressor 238. This is a much reduced volumetric flow rate compared to conventional machines. This reduction is accomplished by provision of the air pressure air manifold 248 coupled to the necking die turret (not shown). The necking die turret provides an overlapping stepped increased air pressure into each of the cans in its pocket 42 on the main star wheel 40. This is accomplished as the main star wheel 40 rotates into the full die insertion position at top dead center (TDC) of each main turret 36 along with recapture or feedback from air released from the inside of each can prior to transfer.

More specifically, low pressure air is initially supplied into the can via the first reuse port 20 (see FIG. 5) as it is picked up from the transfer star wheel 48 and rotated upward. This low pressure air seats the can against the pusher pad 64 and in the pocket 42 of the main star wheel 40 (see FIG. 4). As each can begins entry into the die, air pressure fed through the center of the die into the can is increased to a high pressure. Air pressure is increased to a high pressure to prevent buckling as the die begins necking the can. It is increased as the can is further pressed into the die so that as the can approaches TDC it has full internal support. As the main star wheel 40 continues to rotate beyond TDC, the particular necking operation is now complete and the pusher pad 64 begins to retract. The high pressure air supplied into the can is isolated. The high pressure air in the can pushes the can against the retracting pusher pad 64 and away from the die. During this period, the internal air pressure in the can is bled back to the first regen port 30 and the second regen port 32 rather than releasing it to ambient. After the can is pushed back out of the die as the main star wheel 40 rotates, low pressure air is applied from the low pressure feed port 34 to hold the can against the pusher pad 64 until just prior to the can being picked up by the transfer star wheel 48 with the aid of vacuum for transfer of the can to the next necking module 12 (see FIG. 3).

This recapture of air pressure from the high pressure applied at TDC of the main star wheel 40 is, in essence, a pressure feedback system which conserves the use of pressurized air which provides internal can support during the necking operations. The exhausting high pressure air from within the can is directed to a high pressure reuse surge tank (not shown) and to a low pressure reuse surge tank (not shown).

More particularly, air at low pressure is supplied to the interior of a can via the first reuse port 20 as it is picked up in the can pocket 42 of the main star wheel 40 from the transfer star wheel 48 (see FIGS. 3 and 5). This low pressure air blown into the can pushes the can firmly against the pusher pad 64, properly locating the can for the operation to come. As the main star wheel 40 rotates upward toward TDC, the air pressure is changed to a high pressure to prime the can as it enters the necking tooling. Prior to TDC, high pressure air is supplied into the can via the second reuse port 22 and two high pressure feed ports 24, 26 to provide lateral internal support to the thin side wall of the can during the die forming. Then, as the main star wheel 40 rotates past TDC, the can is no longer being necked. Consequently, the high pressure is no longer needed and the high pressure supply is isolated from the can. The high pressure then bleeds from the can back to the high and low pressure reuse surge tanks via regen ports 30, 32. This bleed back process recoups about 50% of the air volume which would otherwise be required to operate the system. Finally, low pressure air is provided via low pressure feed port 34 to blow the can back from the die prior to the transfer star wheel 48 picking up the can to transfer it to the next stage.

Also included in the air manifold 248 is a monitoring port 28. Monitoring port 28 is typically not used in production, however, it can be accessed to monitor the performance of the air manifold 248 and the air distribution system 10. Monitoring is accomplished by sampling the air pressure and determining whether the pressure is within a suitable range.

Figure 6:
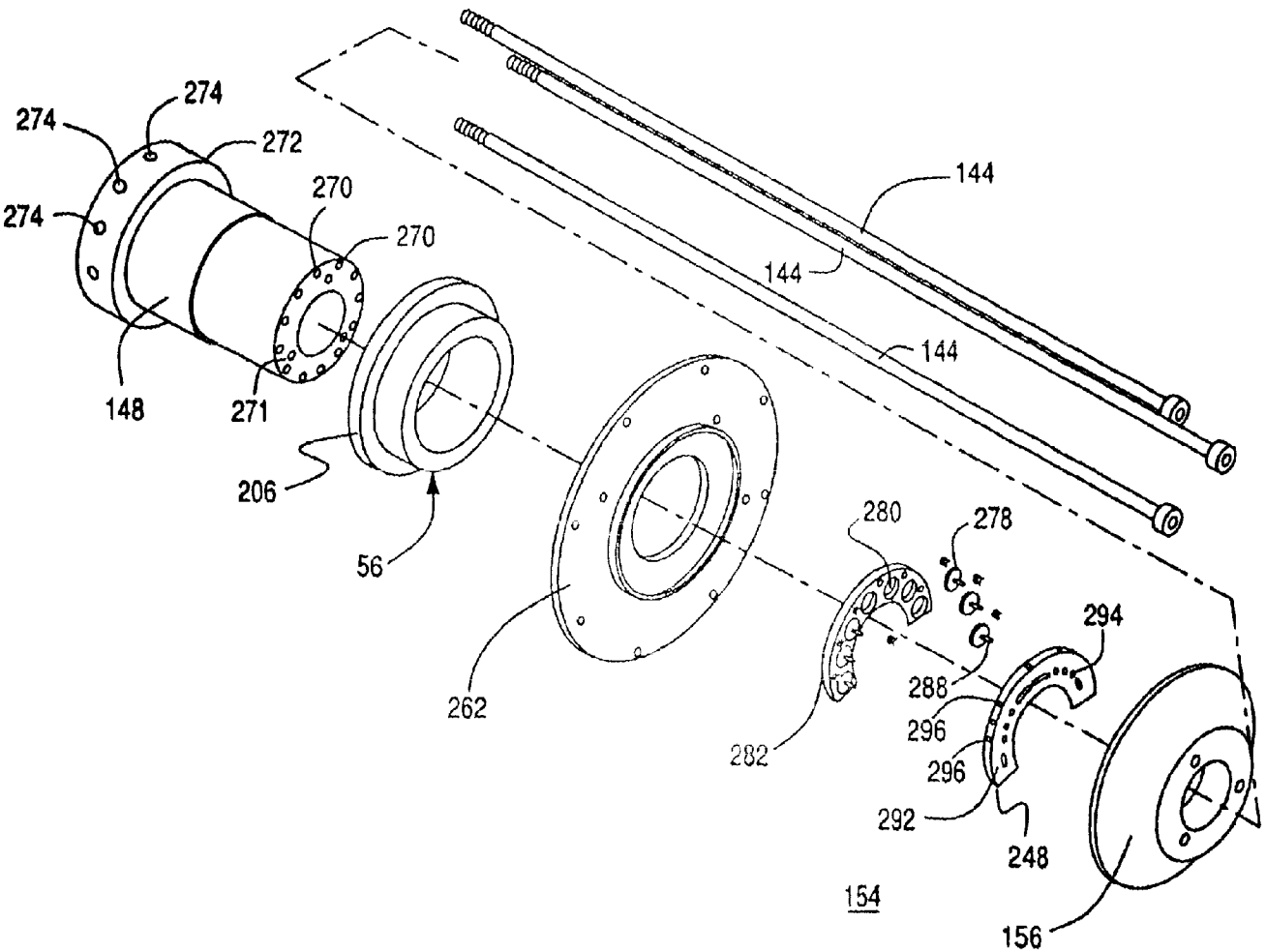
FIG. 6 is an exploded view of a manifold assembly according to the present invention.
Figure 7:
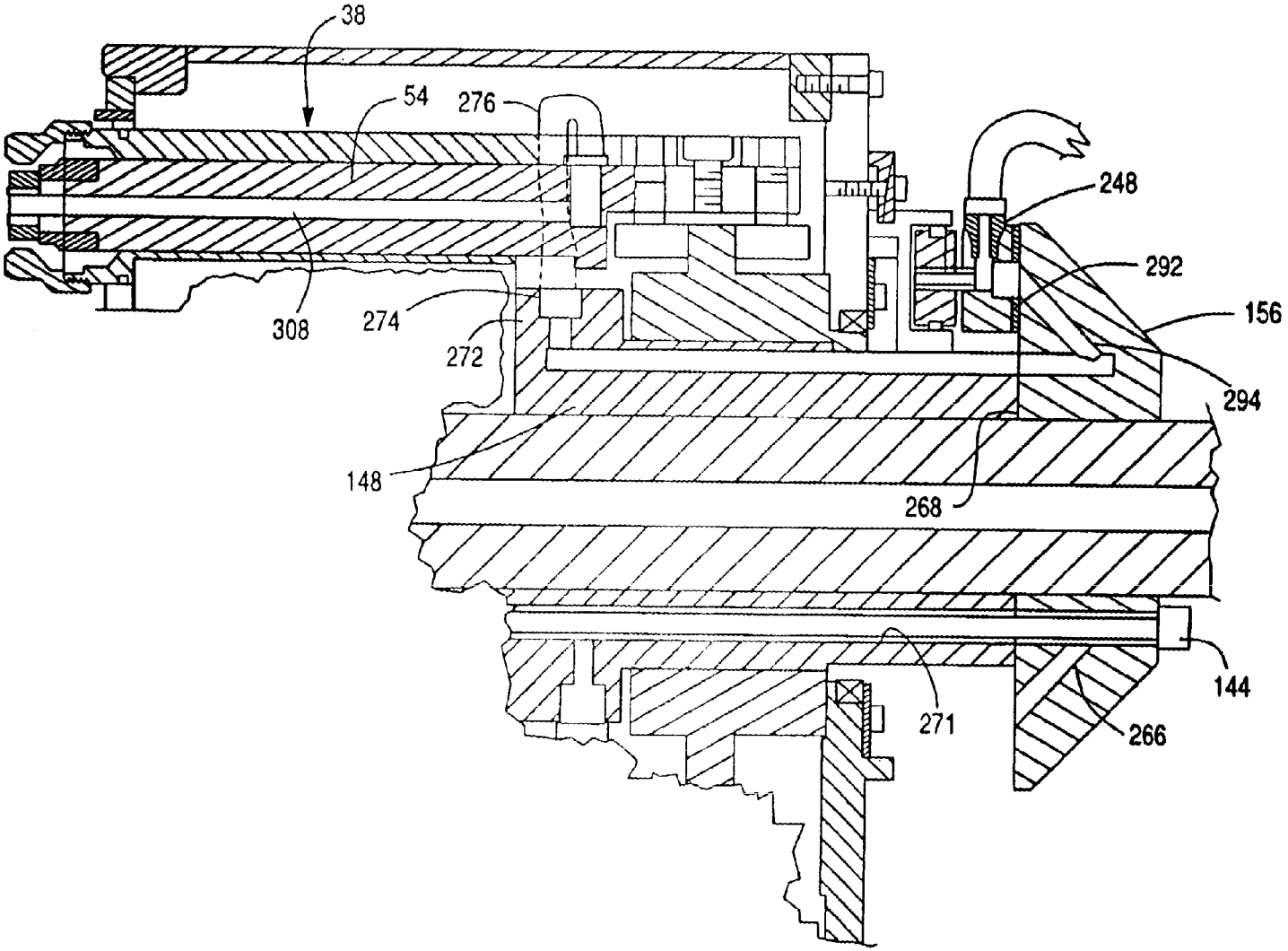
FIG. 7 is a partial cut away view of a necking module according to the present invention.

FIG. 6 illustrates an exploded view of the air manifold assembly 154 while FIG. 7 shows the relationship between the air manifold assembly 154 and the die/knockout ram module 38. The air manifold assembly 154 comprises an annular manifold plate 262, a cam sleeve 56, a horseshoe shaped flat air manifold 248, a horseshoe shaped manifold support 282 which is in turn clamped to the annular manifold plate 262, and the air distribution rotor 156 fastened to the air distribution sleeve 148 on the main shaft (not shown). The air manifold assembly 154 also includes seven hollow piston tubes 288, with pistons 278 fixed to the ends. The pistons 278 are in piston chambers 280 in the manifold support 282. The design and use of the pistons 278 will be discussed in more detail below.

The horseshoe shape of the air manifold 248 and the manifold support 282 allows the air manifold assembly 154 to be removed from the main shaft without a major disassembly operation. The air manifold 248 in one embodiment is made of steel and has a face plate 294 of a low friction, high wear resistance surface material bonded to its rear face 292. The face plate 294 is bonded thereto to minimize friction and wear between the air manifold 248 and the front face 268 of the air distribution rotor 156 during module operations. By way of example, the face plate 294 could be made of Turcite™. In the example embodiment shown, the air manifold 248 has eight threaded radial bores 296 spaced about the periphery of the air manifold 248. Seven of these radial bores 296 intersect with the ports 20–34. Note that the present invention has broad application and is not limited by this specific example.

The front end portion of the distribution sleeve 148 has a radial flange 272 which has twelve threaded ports 274 which connect with the bottom ends of axial bores 270 and 271. A flexible polyflow (reinforced polyethylene) hose 276 connects each port 274 to one of the die/knockout ram modules 38. Additionally, the air manifold assembly 154 is held together by three bolts 144. The die/knockout ram modules 38 are discussed in more detail below.

Figure 8:
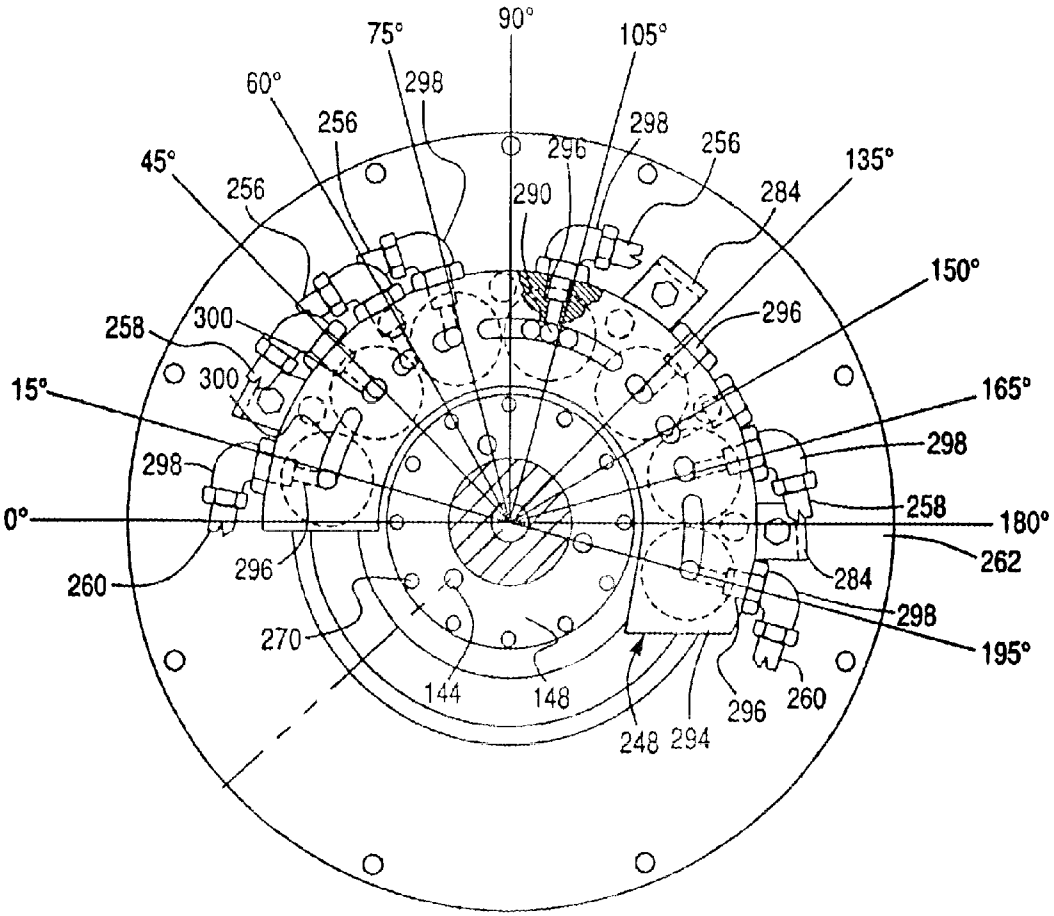
FIG. 8 is a partial cut away view of a manifold assembly according to the present invention.

FIG. 8 is a face view of the air manifold 248 showing the seven air hoses 256, 258 and 260 connected to their appropriate radial bores 296 via fittings 298. The ports 20–34 connect with elongated, arcuate timing slots 300A–300F in the rear face 292 of the air manifold 248. These arcuate timing slots 300A–300F mate with the ore openings 266 in the front face 268 of the air distribution rotor 156 as the air distribution rotor 156 rotates (see FIG. 7). Timing is accomplished by selecting different values for the lengths of the arcuate timing slots 300A–300F. The length of the various arcuate timing slots 300A–300F may be chosen independently. Thus, one or a plurality of the arcuate timing slots 300A–300F may have different lengths and great control can be exercised over the timing of the necking module 12.

As the main shaft rotates, each bore opening 266 intersects with one of the arcuate timing slots 300A–300F to distribute either low pressure, high pressure or no pressure through the air distribution rotor 156, the axial bore 270, ports 274, the flexible polyflow hose 276 into the die/knockout ram module 38 and ultimately into the can in the pocket 42 of the main star wheel 40. Thus, the air manifold 248 provides air pressure application timing during the die necking process of each can while it is on the main turret 36. The rotational position of the air manifold 248 may be adjusted to fine tune this timing by loosening the clamps 284 and rotating the air manifold 248 and manifold support 282 clockwise or counterclockwise.

In operation, as a can is fed into the main star wheel 40, low air pressure is fed through the knockout ram 54 of the die/knockout ram module 38 into the can (see FIG. 7). This stabilizes the can against the pusher pad 64 as the can is transferred from one of the pockets 50 of the transfer star wheel 48 into one of the pockets 42 on the main star wheel 40 of the main turret 36 (see FIG. 4). Increased pressure is then applied as the can enters the throat of the die. This air primes the can with air pressure prior to forming. By using recycled air, there is only a limited waste of compressed air. A further benefit of this supply is that it centers the can in the throat of the die as air is forced out between the outside diameter of the can and the throat of the die.

High pressure is then injected once the can is located in the die. The high pressure air supports the can during the die necking operation. Further, the can pressing against the die form acts as a seal for this high air pressure. At the top of the cycle, there is no additional high pressure feed. As the can leaves the die, residual pressure suffices to strip the can. At the end of the cycle, the low pressure feed stabilizes the can against the pusher pad 64 prior to discharge of the can into the transfer star wheel 48 and ensures ejection of the can from the knockout ram 54.

Figure 9:
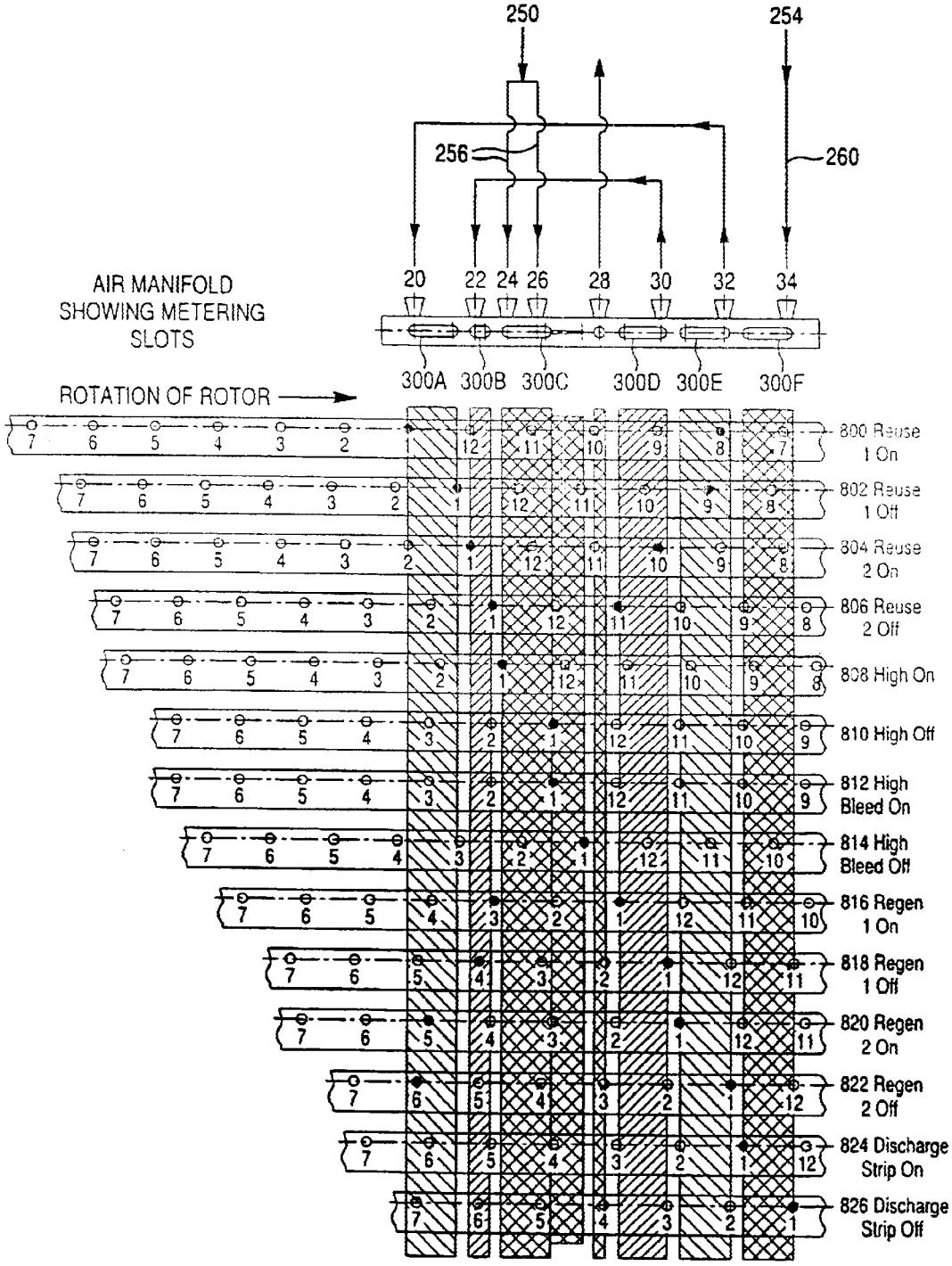
FIG. 9 is a schematic representation of the air manifold in relation to the port holes on a rotor during operation of a necking module of the present invention.

FIG. 9 shows diagrammatically how the air distribution system 10 is configured and how it functions. The high and low pressure headers 250,254 feed three air hoses 256,260 to the air manifold assembly 154: low pressure line 260 and two high pressure lines 256. These lines in turn feed into the arcuate timing slots 300C and 300F which are on the same pitch circle as the twelve bore openings 266 in the front face 268 of the air distribution rotor 156 (see FIG. 7). Each of these bores ultimately feed through a central bore 308 through the knockout ram 54.

The diagram in FIG. 9 shows how the rotor ports move through the different air supplies. Each numbered circle represents a can on the main turret 36 and its port or opening on the front face 268 of the air distribution rotor 156. Each horizontal row 800–826 represents a different angular position of the air distribution rotor 156 as a can passes from the first arcuate timing slot 300A through the last arcuate timing slot 300F. The first arcuate timing slot 300A is sized so that only one rotor port is in the initial feed at any one time. However, as can one is entering the initial low pressure arcuate timing slot 300A (signified by the hashed vertical strip beneath its corresponding arcuate timing slot 300A) another can (can No. 8) is leaving the second regen port arcuate timing slot 300E on the far right. This allows for air to feed between the two ports 20, 32, reducing waste.

A can, i.e., its bore opening 266, will enter the second reuse arcuate timing slot 300B as the bore opening 266 trailing it will enter the first reuse arcuate timing slot 300A (see line 804). Can No. 10 on the trailing side has already primed the surge tank via the first regen port 30 when can No. 1 is connected to the second reuse port 22.

A key feature of the air manifold 248 is that the configuration of the arcuate timing slots 300–300F in the air manifold 248 allows air to be re-used. Note that when the bore opening 266 on the air distribution rotor 156 passes out of the second high pressure arcuate timing slot 300C, the path is blocked (see line 814). The can, at this time, is firmly sealed in the die/knockout ram module 38. When the bore opening 266 reaches the first regen arcuate timing slot 300D, high pressure still resides within the can and passages (line 816). Consequently, air is actually fed from the can and passages back into the high pressure reuse surge tank (not shown) rather than into the atmosphere. This residual air in the can will also As the main turret 36 and air distribution rotor 156 further rotate to position with the particular port in line with the second regen arcuate timing slot 300E, the residual pressure in the can and passages feeds back into a second surge tank (not shown) from whence it can supply the first reuse port 20. This feature provides a substantial savings in air volume required for system operation, on the order of at least 50% less air volume than in comparable conventional machines.

Another feature of the preferred embodiment of the invention is the ability of the air manifold 248 to bleed off a small portion of air and use it to seal itself to the air distribution rotor 156. The seven piston tubes 288, with pistons 278 fixed to the ends, are press fitted in ports 20–34. The positioning of the piston tubes 288 thus correlate with the positions of the arcuate timing slots 300A–300F through the face plate 294 on the rear face 292 (see FIG. 8). The pistons 278 fit in the piston chambers 280 in the manifold support 282. As air is transmitted through the air manifold 248, the majority of the air is fed into the arcuate timing slots 300A–300F, into the bore openings 266 on the air distribution rotor 156 and then into the knockout ram 54. Air is also fed back through each of the piston tubes 288 into the piston chambers 280. This feedback then forces the piston faces, and thus the air manifold 248, onto the front face 268 of the air distribution rotor 156 to create an air tight seal. There are also springs (not shown) adjacent to four of the piston chambers 280 to press the air manifold 248 against the air distribution rotor 156 if no cans are present. Note also that there are different loads exerted between the air manifold 248 and the air distribution rotor 156 via the pistons around the air manifold 248, depending on the pressure of the air being metered through each arcuate timing slot 300A–300F. This has the effect of applying the most load to the areas of the air distribution rotor 156 where the greatest sealing forces are required, i.e., in the areas of high pressure. Once air flow starts, the air pressure under each piston 278 seals the manifold face.

The piston chambers 280 are deep enough to allow for a 0.400" adjustment of neck depth. There will always be a seal between the air manifold 248 and the air distribution rotor 156, irrespective of the position of the air distribution rotor 156 relative to the annular manifold plate 262. In a preferred embodiment, the spacing between the arcuate timing slots 300A–300F is about 0.040" smaller than the diameter of the opening of the bores 266 in the air distribution rotor 156. This is to prevent can collapse due to no internal air pressure being present at machine start-up, i.e., it is not possible for any rotor ports to be starved of air.

The foregoing description of the invention has been presented for purposes of illustration and description. It is not intended to be exhaustive or to limit the invention to the precise form disclosed, and modifications and variations are possible in light of the above teachings or may be acquired from practice of the invention. The drawings and description were chosen in order to explain the principles of the invention and its practical application. It is intended that the scope of the invention be defined by the claims appended hereto, and their equivalents.

What is claimed is:

1. An air manifold for use in a can necking module comprising:

at least one port for supplying low pressure air to pressurize a can prior to necking;

at least one port for supplying high pressure air to pressurize a can prior to necking;

at least one port for bleeding high pressure air from a can after necking;

at least one port for bleeding low pressure air from a can after necking; and not having ports for supplying or bleed air at pressures intermediate between the high and low pressures.

2. An air manifold according to claim 1, wherein the manifold consists of one port for supplying low pressure air to pressurize a can prior to necking;

one port for supplying high pressure air to pressurize a can prior to necking;

one port for bleeding high pressure air from a can after necking;

one port for bleeding low pressure air from a can after necking;

two high pressure feed ports;

a low pressure discharge port; and a monitoring port.

3. An air manifold according to claim 1, wherein the manifold has a horseshoe shape.

4. An air manifold according to claim 1, further comprising arcuate timing slots associated with the ports.

5. An air manifold according to claim 4, wherein a plurality of arcuate timing slots have different lengths.

6. An air manifold according to claim 5, wherein the lengths of the arcuate timing slots are for controlling the timing of a necking module.

7. An air manifold according to claim 6, wherein the spacing between arcuate timing slots is approximately 0.040 inches smaller than the diameter of ports in an air distribution rotor of a necking module.

8. An air manifold according to claim 1, further comprising a port for monitoring the air pressure in the manifold.

9. A necking module comprising:

an air manifold having at least one port for supplying low pressure air to pressurize a can prior to necking, at least one port for supplying high pressure air to pressurize a can prior to necking, at least one port for bleeding high pressure air from a can after necking, at least one port for bleeding low pressure air from a can after necking; and not having ports for supplying or bleeding air at pressures intermediate between the high and low pressures;

a necking die; and an air distribution rotor.

10. A necking module according to claim 9, further comprising a plurality of pistons to seal the air manifold to the air distribution rotor.

11. A necking module according to claim 10, wherein more pressure is applied by the pistons to areas of the air distribution rotor where larger sealing forces are required.

12. An air distribution system for can necking comprising:

an air compressor;

a high pressure line;

a low pressure line; and a least one necking module having an air manifold including at least one port for supplying low pressure air to pressurize a can prior to necking, at least one port for supplying high pressure air to pressurize a can prior to necking, at least one port for bleeding high pressure air from a can after necking, at least one port for bleeding low pressure air from a can after necking, and not having ports for supplying or bleeding air at pressures intermediate between the high and low pressures.

13. An air distribution system according to claim 12, further comprising at least one high pressure regulator and at least one low pressure regulator.

14. An air distribution system according to claim 13, further comprising at least one high pressure header and at least one low pressure header.

15. An air distribution system according to claim 14, further comprising a filter.

16. An air distribution system according to claim 15, wherein the high pressure air is between about 20 and about 50 psi.

17. An air distribution system according to claim 16, wherein the low pressure air is between about 1 and about 10 psi.

18. A method of necking a can comprising the steps of:

supplying a first can to a necking module including an air manifold having ports for low pressure air, ports for high pressure air and not having ports at pressures intermediate between the high and low pressures;

charging a first can with low pressure bleed air through a first reuse port;

charging the first can with high pressure bleed air through a second reuse port; p1 charging the first can with high pressure air from a compressor through at least one feed port;

inserting the first can into a necking die;

necking the first can;

bleeding high pressure air from the first can to at least one succeeding can through a first regen port; and bleeding low pressure air from the first can to at least one succeeding can through a second regen port.

19. A method of necking a can according to claim 18, wherein the step of charging the first can with low pressure bleed air seats the first can against a pusher pad.

20. A method of necking a can according to claim 18, wherein the step of charging the first can with high pressure bleed air increases the pressure in the first can sufficiently to prevent buckling in a necking die.

21. A method of necking a can according to claim 18, further comprising the step of retracting the first can from the necking die.

22. A method of necking a can according to claim 21, wherein high pressure air pushes the first can against the pusher pad while retracting the first can from the necking die.

23. A method of necking a can according to claim 22, further comprising the step of supplying low pressure air from a compressor to eject the first can from the necking die.

* * * * *